US010688649B1

(12) United States Patent
Downey

(10) Patent No.: US 10,688,649 B1
(45) Date of Patent: Jun. 23, 2020

(54) IMPLEMENT HANDLE GRIP HAVING AN IMPROVED HANDLE ENGAGING MECHANISM

(71) Applicant: Martinez Tool Company, Inc., Stockton, CA (US)

(72) Inventor: Phil Downey, Henderson, NV (US)

(73) Assignee: Martinez Tool Company, Inc., Stockton, CA (US)

( * ) Notice: Subject to any disclaimer, the term of this patent is extended or adjusted under 35 U.S.C. 154(b) by 0 days.

(21) Appl. No.: 15/432,169

(22) Filed: Feb. 14, 2017

(51) Int. Cl.
*B25G 3/14* (2006.01)
*B25G 1/10* (2006.01)

(52) U.S. Cl.
CPC ..... *B25G 3/14* (2013.01); *B25G 1/102* (2013.01); *B25G 1/105* (2013.01)

(58) Field of Classification Search
CPC ... B25G 3/12; B25G 3/14; B25G 3/18; B25G 1/102; B25G 1/105
USPC ..... 16/421
See application file for complete search history.

(56) References Cited

U.S. PATENT DOCUMENTS 3,915,782 A * 10/1975 Davis ..... B29C 65/00 156/294
5,581,845 A * 12/1996 Yang ..... B25G 1/102 16/421
5,588,343 A * 12/1996 Rust ..... B25G 1/102 81/20
5,911,795 A * 6/1999 Tucker ..... B25G 1/102 76/103
6,247,385 B1 * 6/2001 Wu ..... B25B 23/16 81/177.1
6,386,070 B1 * 5/2002 Hong ..... B25G 3/18 16/110.1
6,609,443 B2 * 8/2003 Murray ..... B25G 1/01 81/177.1
6,619,408 B1 * 9/2003 Lai ..... B25G 1/01 16/110.1
8,650,993 B2 * 2/2014 Chen ..... B25G 3/18 81/487
9,259,829 B1 * 2/2016 Cougar ..... B25D 1/04
9,573,267 B2 * 2/2017 Fegan ..... B25G 1/102
10,369,687 B2 * 8/2019 Levand ..... B25G 3/26
10,569,409 B2 * 2/2020 Chen ..... B25G 3/14
10,583,549 B2 * 3/2020 Holm ..... B26B 23/00
10,583,550 B2 * 3/2020 Lombardi ..... B25G 1/102
2002/0073554 A1 * 6/2002 Chen ..... B25G 3/18 30/169

(Continued)

*Primary Examiner* — Jeffrey O'Brien
(74) *Attorney, Agent, or Firm* — Richard A. Ryan

(57) ABSTRACT

A handle grip for use with a handle. The handle grip has a grip sleeve and a grip attachment mechanism that securely attaches the handle grip to the handle in a manner which allows the handle grip to be easily removed and replaced. In one configuration, the attachment mechanism is a locking clip with two locking members positioned inside of a channel through the grip sleeve. At least one of the locking members has engaging members on an engaging surface thereof. When the handle grip is positioned on the handle, the engaging members engage the gripping elements of a grip engaging pattern on an adjacent engaging surface of the handle. A base member joins the locking members and closes the bottom of the channel. A locking pin can be inserted through the grip sleeve, locking clip and handle to more securely join the handle grip to the handle.

21 Claims, 8 Drawing Sheets

(56) References Cited

U.S. PATENT DOCUMENTS

| | | | | |
|---|---|---|---|---|
| 2006/0123955 | A1* | 6/2006 | Cho | B26B 21/12 81/177.2 |
| 2012/0117744 | A1* | 5/2012 | Tanaka | A47L 13/46 15/231 |
| 2012/0124763 | A1* | 5/2012 | Tanaka | A47L 13/46 15/154 |
| 2012/0159794 | A1* | 6/2012 | Vogel | B25G 3/18 30/340 |
| 2016/0039078 | A1* | 2/2016 | West | B25D 7/00 81/22 |
| 2016/0346908 | A1* | 12/2016 | Liu | B25B 15/02 |
| 2017/0136617 | A1* | 5/2017 | Lucas, Jr. | B25G 1/102 |
| 2018/0112700 | A1* | 4/2018 | Held | B25G 3/18 |
| 2018/0178369 | A1* | 6/2018 | Chen | B25G 3/18 |
| 2019/0009151 | A1* | 1/2019 | Breeden, III | A63B 60/14 |
| 2019/0255691 | A1* | 8/2019 | Paulsen | B25D 1/02 |
| 2019/0270191 | A1* | 9/2019 | Levand | B25F 1/006 |

* cited by examiner

IMPLEMENT HANDLE GRIP HAVING AN IMPROVED HANDLE ENGAGING MECHANISM

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to tools, utensils, sporting equipment and like implements that comprise a handle which is gripped by the user during use of the implement. More particularly, the present invention relates to handle grips that are received on or over the handle of such implements and which are secured to the handle with a handle engaging mechanism. Even more particularly, the present invention relates to such handle grips that are configured to be removed from the implement for replacement of the handle grip.

B. Background

Hand-held tools, utensils, sporting equipment and like implements have been in use for a very long time and are generally available in a wide variety of different configurations which are each beneficially constructed and selected to accomplish one or more tasks. As well known in the art, such implements have a head or other working portion that is specifically configured to accomplish the objectives associated with using the implement and a handle that is configured to be grasped by the user when utilizing the implement. For instance, tools such as hammers, screwdrivers, ratchets, shovels, hoes, picks, axes and the like have an elongated handle that is attached to or integrally formed with the head, sharp end or other working portion of the tool. Utensils such as knives, spatulas, prongs and the like also have an elongated handle to which is attached or integrally formed with the blade or other working portion of the utensil. Sporting equipment such as racquets, clubs, bats, sticks, paddles and the like also have a handle, which is typically at least somewhat elongated, that is attached to or integrally formed with the portion of the sporting equipment that is, typically, utilized to hit or otherwise contact a ball or other object which is utilized with the sporting equipment to play a game. The tools, utensils, sporting equipment set forth above are identified for exemplary purposes only of implements with which the present invention can be utilized. As will be readily appreciated by persons skilled in the art, the present invention will be able to be beneficially utilized with a wide variety of implements having handles.

The handles of such hand-held implements have a gripping section that is sized and configured to be comfortably, securely and safely held in the hand of the user so the user can swing, twist, drive, push or perform other motion with his or her arm and/or hand to move the handle in a specific manner to direct the working portion of the implement to accomplish the desired activity (such as hammer a nail, turn a screw, cut an object, hit a ball and etc.). Although some of these implements may be configured for the user to directly grab onto the handle, many implements have a handle grip that is positioned over the handle at the gripping section thereof for the user to grasp directly with his or her hands. The handle grip is generally configured to improve the performance of the implement and/or for the benefit of the user. For instances, in some uses the handle grip is provided to allow the user to more securely grip the handle, particularly when the handle is made out of smooth, hard surfaces, such as handles that are round and/or formed of metal, or when it is necessary for the user to exert force against the handle of the implement, such as screwdrivers and the like. In other uses, the handle grip is provided to make the implement more comfortable in the user's hand, such as when the gripping portion of the handle can get hot or cold or when use of the implement is likely to result in shock forces being directed to the user's hand, such as when using a hammer, axe or the like. For other implements, the handle grip is provided to reduce the likelihood that the user's grip will loosen and the implement will slip from the user's hand, such as may occur when using a knife, racquet or other implements. The gripping section of the handle thereof may be coated, covered, imbedded with or otherwise comprise a gripping material, such as rubber, plastic and the like to form the handle grip and, thereby, provide the user with the ability to better grip the handle. In one common configuration, which is utilized for a wide variety of implements, the handle grip is attached to or formed around an existing handle.

As will be readily appreciated by persons skilled in the art, for many implements the working portion and handle of the implement are made out of materials and configured such that they will last longer, usually much longer, than the handle grip. This is most often due to the difference between the materials that are utilized for the handle grip, which are usually chosen for gripping features (such as being comfortable in the user's hand), versus the materials that are utilized for the working portion and handle of the implement, which are often chosen for strength and durability. Over time, due to use, the handle grip may become worn to the point that it will no longer provide the gripping action that is necessary for the user to comfortably, effectively and/or safely use the implement. The handle grip may become damaged by contact with an item with which the implement is being utilized, by inadvertent contact with other objects or by exposure to sunlight, hot or cold temperature and fluids, particularly acidic liquids and gases, even when such exposure is part of the intended use of the implement with which the handle grip is associated. When the handle grip is no longer comfortable, effective and/or safe to use, the user must either replace the implement, which may have a working portion that is still suitable for many years worth of use, or replace the handle grip itself.

As set forth above, for some implements the handle grip is attached in a manner in which it is relatively easy to replace. In fact, for some implements the entire gripping section of the handle is removably attached to the remaining portion of the handle and, for other implements, the handle may be removably attached to the working portion of the implement. For these types of implements, the user can replace a worn or damaged handle grip. However, for many types of implements, it is impractical or not safely possible to provide the implement with a removably attached gripping section or handle. For these implements, the user must remove the worn or damaged handle grip from the gripping section of the handle which often requires the user to cut off the old handle grip, before installing the new handle grip. Unfortunately, for many implements it is not safe to provide the implement with an easily removable handle grip. As will be readily appreciated by persons who are skilled in the art, the use that is expected for some types of tools, utensils, sporting equipment and other implements is such that an easily removably handle grip does not provide the secure attachment that is required to safely utilize the implement. For instance, a handle grip that can be easily removed from a hammer or other striking tools can result in the handle grip inadvertently disengaging when the tool is being utilized, which will be dangerous for the user and/or others near him or her. Other implements have the same, or substantially the same, problem.

One solution for implements where it is difficult to replace a worn or damaged handle grip with a new handle grip, is to have the handle grip removed by a person knowledgeable and skilled with doing such work. Often, this requires the user to send his or her implement back to the factory where the implement was manufactured to have a new handle grip installed. Although this may be less expensive than replacing the entire implement, the cost associated with shipping the implement back to the factory and to have the factory install a new handle grip can be quite significant. In addition to the user's direct cost for shipping and replacing the handle grip, the user will be without his or her implement for the length of time it takes to ship the implement, both ways, and for the factory to do the actual work of replacing the handle grip. For many users, the amount of time it takes to accomplish the replacement of the handle grip is very inconvenient and, often, requires the user to obtain a replacement implement while he or she is waiting for the new handle grip.

What is needed, therefore, is an improved handle grip for use on the handle of an implement. More specifically, there is a need for a handle grip that can be utilized with an implement that can be securely attached to the gripping section of the handle of the implement and which the user can relatively easily remove for replacement of the handle grip. The mechanism for joining the handle grip to the handle of an implement should be configured to securely, safely and effectively join the handle grip to the handle so the handle grip will not become loose or disengaged during use of the implement. Preferably, the improved handle grip should be configured so it can be utilized with a wide variety of different types of implements, including tools, utensils, sporting equipment and the like, so the benefits thereof can be utilized with such implements. The new implement handle grip should be adaptable for being made out of a wide variety of different materials and in a wide variety of configurations, including the materials and configurations presently utilized for handle grips.

SUMMARY OF THE INVENTION

The implement handle grip of the present invention solves the problems and provides the benefits identified above. That is to say, the present invention discloses a new implement handle grip having an improved mechanism for attaching the handle grip to the gripping portion of the handle of an implement. The mechanism which joins the handle grip to the handle of an implement is structured and arranged such that it securely, effectively and safely joins the handle grip to the handle so the handle grip will not slip and will not become disengaged from the handle during use of the implement. Although the new handle grip securely attaches to the handle of an implement, it is also configured such that the user can relatively easily remove the handle grip when he or she desires or needs to replace the handle grip. Because the user can remove and replace the handle grip himself or herself, there is no need to send the implement to anyone else for replacement. As such, the new implement handle grip of the present invention eliminates much of the costs that would be associated with shipping and having another person replace the handle grip and the loss of use of the implement during such shipping and repair. The improved handle grip of the present invention can be utilized on the handle of a wide variety of different types of implements, including tools, utensils, sporting equipment and the like. The new implement handle grip is adaptable for being made out of a wide variety of different materials and in a wide variety of configurations, including materials and configurations that are presently utilized for implement handle grips.

In one general aspect of the present invention, the new handle grip comprises a tubular-shaped grip sleeve and a grip securing mechanism for securing the grip sleeve to the handle body of a gripping section of a handle. The grip sleeve has one or more walls that define an interior channel through the grip sleeve between an upper end and a lower end thereof. The tubular grip sleeve is sized and configured to substantially surround the handle body of the gripping section of the handle when the gripping section of the handle is positioned in the interior channel of the grip sleeve. The handle body at the gripping section of the handle has a first engaging surface with a grip engaging pattern thereon that has one or more engaging elements. In one embodiment of the present invention, the grip securing mechanism comprises a first locking member having an engaging surface with one or more engaging members thereon. The first locking member is positioned in the interior channel of the grip sleeve to dispose the engaging surface of the first locking member substantially adjacent a first engaging surface of the handle body of the handle when the gripping section thereof is positioned inside the interior channel of the grip sleeve. The engaging members on the engaging surface of the first locking member are sized and configured to engage at least one of the engaging elements of the grip engaging pattern so as to securely attach the grip sleeve to the handle when the grip sleeve is positioned on the gripping section of the handle. In a preferred configuration, the first locking member extends substantially between the lower end of the gripping section and the upper end of the gripping section and the engaging surface of the first locking member is substantially parallel to the first engaging surface of the handle body of the gripping section of the handle. The grip securing mechanism can also include a locking pin that is received through a pin aperture on the grip sleeve and a pin aperture through the handle body so as to interconnect the handle grip and the handle. The locking pin should be sized and configured to engage at least one of the grip sleeve and the handle body so as to securely join the grip sleeve to the gripping section of the handle.

In another embodiment, the grip securing means comprises a locking clip having a first locking member, a second locking member in spaced apart relation to the first locking member and a base member interconnecting the first locking member and the second locking member. Each of the first and second locking members have engaging surfaces, with the engaging surface of the first locking member and the engaging surface of the second locking member defining a gap therebetween. Each of the first locking member and the second locking member are positioned in the interior channel of the grip sleeve so as to dispose the engaging surface of the first locking member substantially adjacent the first engaging surface of the handle body of the handle and the engaging surface of the second locking member substantially adjacent the second engaging surface of the handle body when the gripping section of the handle body is positioned in the interior channel of the grip sleeve. At least the first engaging surface of the handle body has a grip engaging pattern with one or more engaging elements. The engaging members on the engaging surface of the first locking member are sized and configured to engage at least one of the engaging elements of the grip engaging pattern so as to securely attach the grip sleeve to the handle when the grip sleeve is positioned on the gripping section of the handle. In one of the preferred configurations, the locking clip is sized and configured so as to position the base member at the lower end of the grip sleeve when each of the first locking member and the second locking member are fully disposed in the interior channel of the grip sleeve and to dispose the base member at a lower end of the gripping section when the handle grip is positioned on the gripping section of the handle with the gripping section thereof disposed in the gap. In an alternative embodiment, the engaging surface of the second locking member also has one or more engaging members and the second engaging surface of the handle body also has the grip engaging pattern with the engaging elements. The engaging members on the engaging surface of the second locking member engage the engaging elements of the grip pattern on the second engaging surface when the grip sleeve is positioned on the gripping section of the handle. As with the above embodiment, the grip securing means can further comprise a locking pin that is received through a pin aperture on the handle grip, through a pin aperture on the first locking member and/or a pin aperture on the second locking member, and a pin aperture on the handle body so as to interconnect the grip sleeve, the locking clip and the handle. The locking pin is sized and configured to engage at least one of the grip sleeve, the first locking member or the second locking member, and the handle body so as to securely join the handle grip to the gripping section of the handle. In a preferred configuration, each of the engaging elements have a downwardly directed outward sloping surface that defines a downwardly disposed engaging edge that is sized and configured to engage one of the engaging elements of the grip engaging pattern.

The present invention disclosed herein also describes a handle system comprising a handle having a gripping section, a handle body at the gripping section and the handle grip described above. The handle body has a first engaging surface and an opposite facing second engaging surface, with at least the first engaging surface of the handle body having a grip engaging pattern with one or more engaging elements that are sized and configured to be engaged by the engaging members on engaging surface of the first locking member.

Accordingly, the primary objective of the present invention is to provide an improved implement handle grip that provides the advantages discussed above and overcomes the disadvantages and limitations associated with presently available handle grips for implements.

It is also an important object of the present invention to provide a new implement handle grip that utilizes an improved mechanism for connecting a handle grip to the handle of an implement which will allow the user to relatively easily remove the handle grip from the handle to replace the handle grip as needed or desired.

Another important object of the present invention is to provide a new implement handle grip that has a grip securing mechanism that is structured and arranged to securely, effectively and safely join the handle grip to the handle of an implement, including tools, utensils, sporting equipment and the like.

An important aspect of the present invention is that it provides a new implement handle grip that achieves the goals of the above-described objectives.

An important aspect of the present invention is that it provides a new implement handle grip that has an improved grip securing mechanism for securely, effectively and safely attaching a handle grip to the gripping portion of the handle of an implement in a manner that prevents the handle grip from slipping or becoming disengaged during use of the implement.

Another important aspect of the present invention is that it provides an improved implement handle grip that has a grip securing mechanism which is configured to securely attach to the handle of an implement and is configured such that the user can relatively easily remove the handle grip from the handle of the implement and install a new handle grip when he or she desires or needs to replace the implement's existing handle grip.

Another important aspect of the present invention is that it provides an improved implement handle grip that eliminates shipping and labor costs that would otherwise be required to ship an implement to a factory or another location to have another person replace the handle grip of the implement and the loss of the use of the implement during the time the implement is being shipped and repaired.

Another important aspect of the present invention is that it provides an improved implement handle grip that can be utilized on the handle of a wide variety of different types of implements, including various tools, utensils, sporting equipment and the like.

Yet another important aspect of the present invention is that it provides a new implement handle grip which is adaptable for being made out of a wide variety of different materials and in a wide variety of configurations, including the materials and configurations that are presently utilized for implement handle grips.

As will be explained in greater detail by reference to the attached figures and the description of the preferred embodiment which follows, the above and other aspects are provided or accomplished by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more of the preferred embodiments and, as such, only represent several possible ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the illustrations and description provided herein are generally directed to certain configurations of implement handle grips and types of implements, namely a claw hammer and a screwdriver, and to certain materials for the handle grips and implements, persons who are skilled in the relevant art will readily understand that such discussion and illustrations are merely for purposes of simplifying the present disclosure and that the present invention is not so limited. In addition, the exemplary embodiments of the present device are shown and described with only those components which are required to disclose the present invention. It may be that some of the necessary elements for manufacturing, attaching and using the present invention are not shown or are not necessarily described below, but these elements are well known to persons who are skilled in the relevant art. As will be readily appreciated by such persons, the various elements of the present invention that are described below may take on any form consistent with forms that are readily realized by persons of ordinary skill in the art having knowledge of handle grips, handles and implements. As will be further appreciated by persons who are skilled in the art, the new and improved features of the implement handle grip of the present invention can be incorporated into a wide variety of different types of implements and can be made in a wide variety of different configurations and out of a wide variety of materials.

Figure 1:
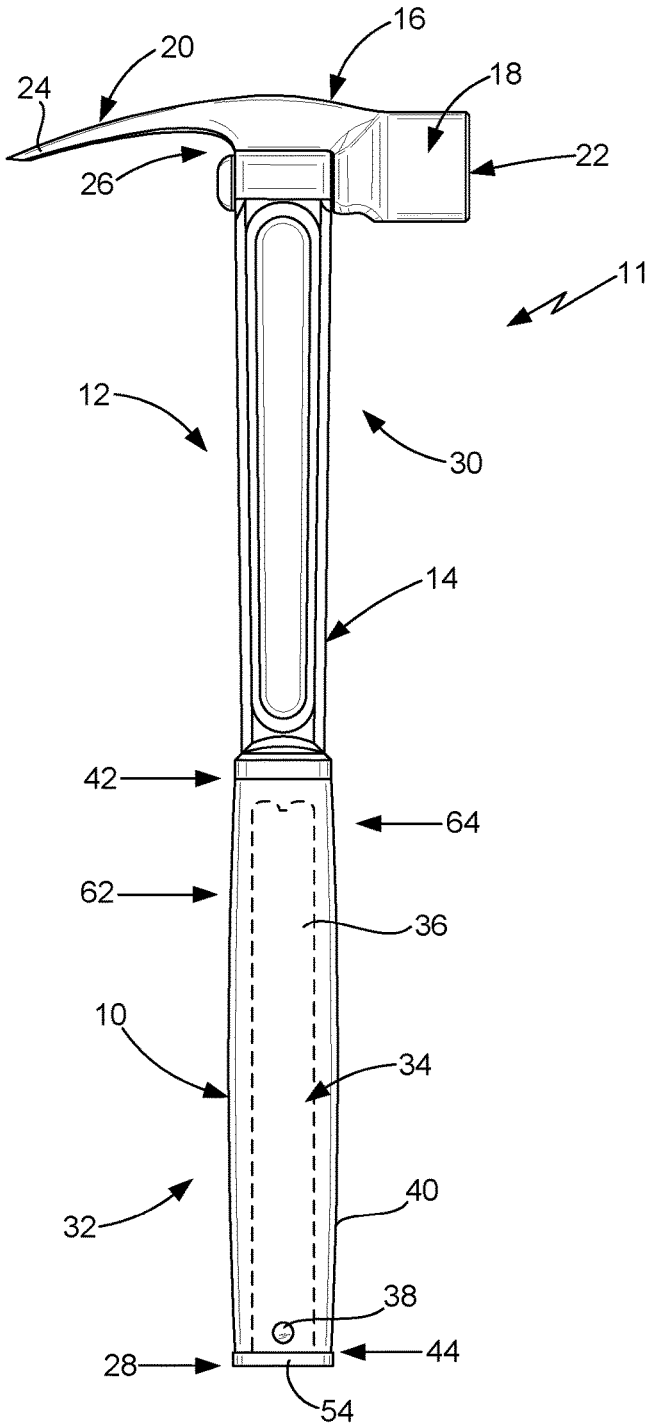
FIG. 1 is a side view of a handle grip that is configured according to a first embodiment of the present invention, with the handle grip shown attached to the handle of an implement that is configured as a claw hammer.
Figure 2:
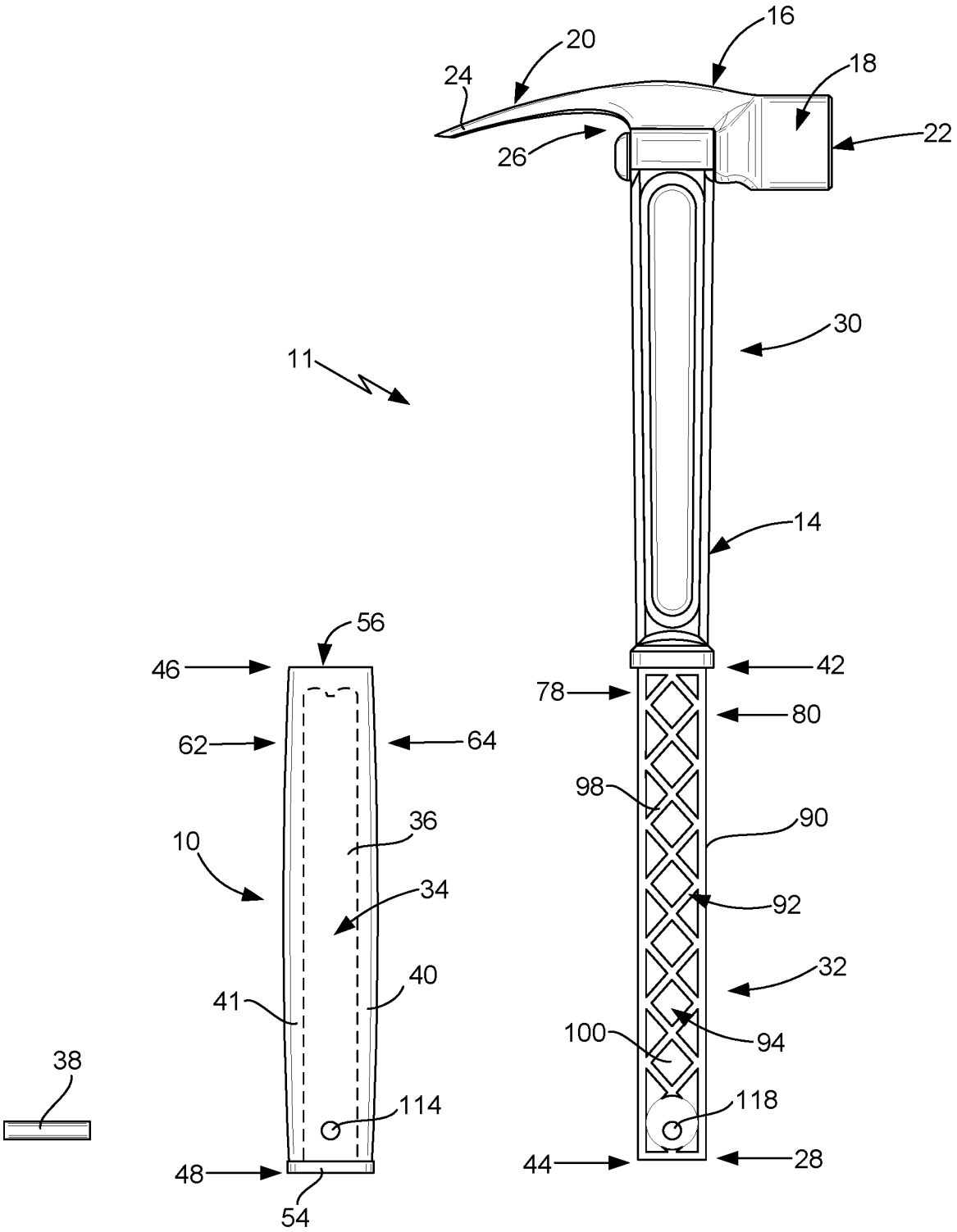
FIG. 2 is a side view of the handle grip and implement of FIG. 1, with the handle grip shown separated from the gripping section of the handle of the implement.

An improved implement handle grip that comprises the components and which is configured pursuant to various embodiments of the present invention is shown generally as 10 in FIGS. 1-2, 5-6 and 12. As best shown in FIG. 1, the handle grip 10 of the present invention is structured and arranged to be utilized with an implement 12 having an elongated handle 14. As will be readily familiar to those skilled in the art, the exemplary implement 12 shown in FIG. 1 is configured as a striking tool, or more specifically a claw hammer, with the head or working member 16 thereof having a striking section 18 and a claw section 20. The striking section 18 has an outwardly disposed striking face 22 that is shaped and configured to strike against an object, such as the head of a nail or the like. The claw section 20 has a pair of divergently spaced apart claw members 24 that are shaped and configured to allow the user of this particular implement 12 to pull a nail out of a piece of wood or other item. As best shown in FIGS. 1 and 2, the handle 14 of the implement 12 has an upper end 26 and a lower end 28, with an upper section 30 of the handle 14 generally toward the upper end 26 thereof and a lower or gripping section 32 of the handle 14 generally toward the lower end 28 thereof. The new handle grip 10 is shown attached to the gripping section 32 of the handle 14 in FIG. 1 and separate from the gripping section 32 in FIG. 2.

Figure 12:
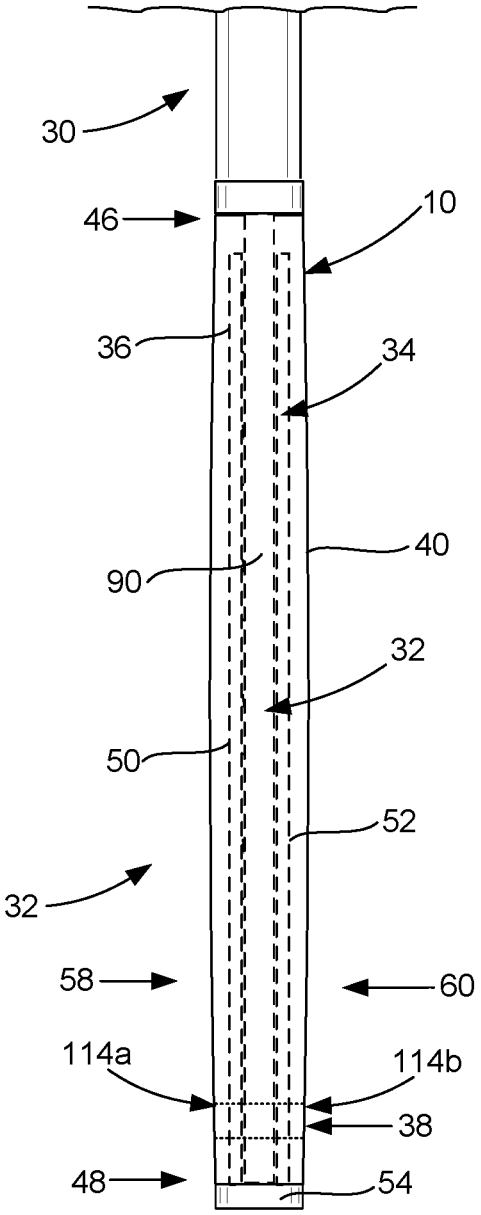
FIG. 12 is an end view of the handle grip of FIG. 2 showing the gripping section of the handle received in the locking clip.

As will be readily appreciated by persons who are skilled in the art, the configuration of the implement 12 shown in FIGS. 1 and 12 will be generally the same for other types of implements with regard to having a handle 14 and a working portion 16, although either or both the handle 14 and working portion 16 may be configured significantly different than for the claw hammer of FIG. 1 and the screwdriver of FIG. 12. The implements set forth above are identified in the present disclosure for exemplary purposes to illustrate example implements with which the handle grip 10 of the present invention can be utilized. As will be readily appreciated by persons skilled in the art, the present invention will be able to be beneficially utilized with a wide variety of implements having handles 14. For instance, the new handle grip 10 can be utilized with a variety of hand-held tools, utensils, sporting equipment and like implements 12 that are generally available in a wide variety of different configurations which are each beneficially constructed and selected to accomplish one or more tasks. As well known in the art, the working portion 16 of an implement 12 is configured to accomplish the various objectives associated with using the implement 12 and the handle 13 is configured to be grasped by the user when he or she is utilizing the implement 12. For instance, as set forth in the Background, tools such as hammers, screwdrivers, ratchets, shovels, hoes, picks, axes and the like have an elongated handle 14 that is attached to or integrally formed with the head, sharp end or other working portion 16 of the tool. Utensils such as knives, spatulas, prongs and the like also have an elongated handle 14 to which is attached or integrally formed with the blade or other working portion 16 of the utensil. Sporting equipment such as racquets, clubs, bats, sticks, paddles and the like also have a handle 14, which is typically at least somewhat elongated, that is attached to or integrally formed with the working portion 16 of the sporting equipment that is, typically, utilized to hit or otherwise contact a ball or other object which is utilized with the sporting equipment to play a game. It is anticipated that the new handle grip 10 of the present invention will be able to be utilized with a wide range of implements 12, in addition to those set forth above, having a wide variety of different types of handles 14 and working portions 16.

The handle 14 and working portion 16 of the implement 12 of the present invention can be made out of a wide variety of different materials, with the handle 14 and working portion 16 either being the same material or being different materials. In one embodiment, the working portion 16 is made out of hardened steel, as is common for many hammers, axes, picks and other striking tools, and formed by a casting or forging process. In another embodiment, the working portion 12 can be made out of titanium, a titanium-based alloy or other relatively lighter weight materials (i.e., lower density than hardened steel). The handle 14 of the implement 12 can be made out of wood, polymers and a variety of metals, including hardened steel, aluminum, titanium and the like. The lower or gripping section 32 of the handle 14 is beneficially sized and configured for the user to securely, safely and comfortably grip the implement 12 and to maintain that grip as he or she swings, twists or otherwise utilizes the implement 12 to accomplish the desired objectives, such as contacting the striking section 18 of the working portion 16 against an object, turning a screw or the like. As set forth in the Background, the gripping section 32 of the handle 14 may be coated, covered, imbedded with or otherwise comprise a gripping material that is selected to allow the user to have a better grip on the handle 14 when he or she operates the implement 12. For some implements 12, the gripping material is also chosen based on its ability to absorb some of the contact force that may result from the implement being utilized to hit or otherwise forcefully contact an object. In one configuration, the gripping material is a sleeve that is made out of rubber, plastic or like material which is placed on the gripping section 32 of the handle 14 and then secured thereto with an adhesive or other binding agent. Alternatively, the gripping material may be formed around the gripping section 32 of the handle 14. A wide variety of other materials can be utilized for the gripping material 32. As set forth in the Background, because removal of the gripping material can be difficult and, even if removed, the user typically cannot install new gripping material around the handle 14, the user typically sends the implement 12 to the factory or other location to have someone else install new gripping material.

As well known in the art, it would be beneficial to have a handle grip that is easier to remove and easier for the user to install a new handle grip on the gripping section 32 of the handle 14. However, for an implement 12 having such a handle grip to function for its intended purpose, such a handle grip must be effectively, securely and safely attached to the handle 14. The handle grip 10 of the present invention utilizes an improved grip securing mechanism, shown generally as 34 in FIGS. 1-2, 5-6 and 12, for effectively, securely and safely attaching the handle grip 10 of the present invention to the handle 14. As set forth in more detail below, the grip securing mechanism 34 is structured and arranged to prevent the handle grip 10 from slipping or becoming disengaged during use of the implement 12. In the embodiment of the handle grip 10 that is shown in FIGS. 1-2, 5-6 and 12, the grip securing mechanism 34 is a combination of: (1) a locking clip 36 that engages certain features of the gripping section 32 of the handle 14; and (2) a locking pin 38 that is received through the handle grip 10 and the gripping section 32 of the handle 14. As will be readily appreciated by persons who are skilled in the art, use of the grip securing mechanisms 34 shown in the figures and described in detail below can be utilized with a wide variety of different types of handle grips 10, implements 12 and handles 14, and materials for the handle grip 10 and handle 14, that can be connected together as may be desired by the manufacturer and/or users of the implement 12.

Figure 3:
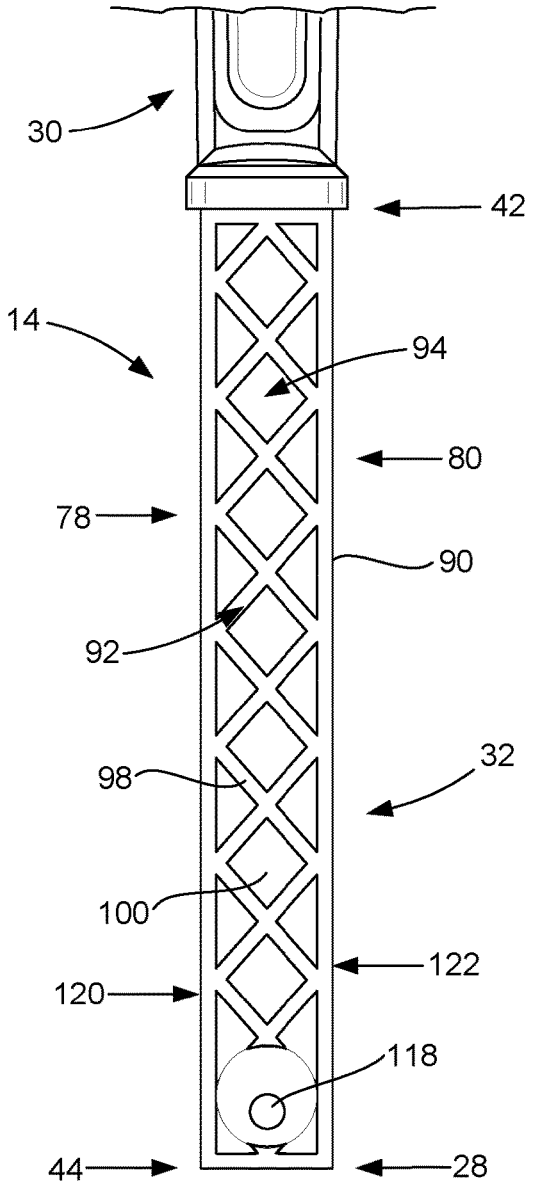
FIG. 3 is a side view of the gripping section of the handle of the implement of FIG. 2.
Figure 4:
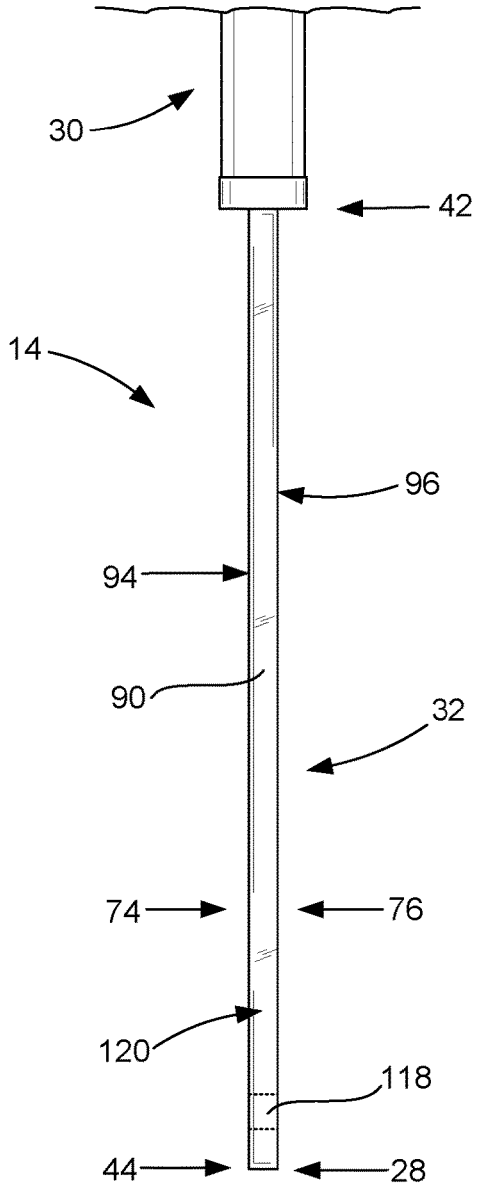
FIG. 4 is an end view of the gripping section of the handle of the implement of FIG. 3.

In a preferred embodiment of the present invention, the new handle grip 10 comprises a tubular grip sleeve 40, having one or more walls 41, in which the locking clip 36 of the grip securing mechanism 34 is positioned and through which the locking pin 38 is received to secure handle grip 10 to handle 14 having a specially configured gripping section 32, as shown in FIGS. 2-4. Preferably, the grip sleeve 40 is sized and configured to entirely surround and envelope the gripping section 32 of the handle 14 from the upper end 42 to the lower end 44 of the gripping section 32, as shown in FIGS. 1-2 and 12. For the implements 12 shown in the figures, the lower end 44 of the gripping section 32 corresponds to the lower end 26 of the handle 14. For other implements 12, the lower end 44 of the gripping section 32 may not correspond to the lower end 26 of the handle 14. As described in more detail below, the locking clip 36 of the grip securing mechanism 34 will generally extend upward from the lower end 44 of the gripping section 32 toward the upper end 42 thereof. For purposes of describing the present invention, the terms "upward", "upper" and the like and the terms "downward" and "lower" are utilized in reference to the implement 12 being held with the working portion 16 positioned above the handle 14 in the manner shown in FIGS. 1 and 12.

Figure 5:
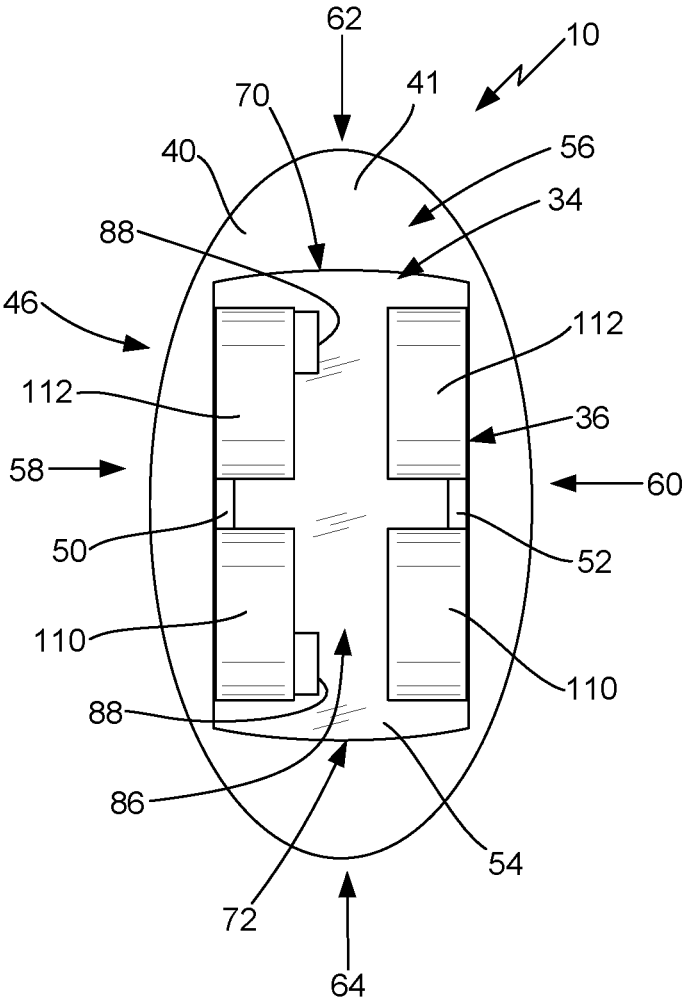
FIG. 5 is a top view of the handle grip of FIG. 2.
Figure 6:
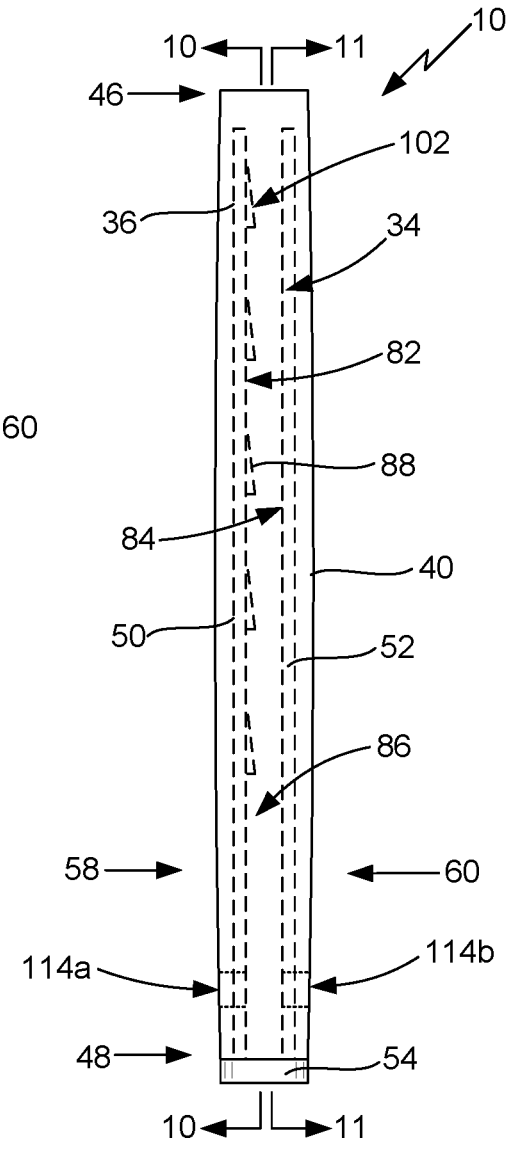
FIG. 6 is an end view of the handle grip of FIG. 2.

As best shown in FIGS. 5-6, the grip sleeve 40 of the new handle grip 10 is generally tubular shaped, with the walls 42 thereof defining an interior channel 56 through the grip sleeve 40, and sized and configured to envelope the gripping section 32 of the handle 14. The grip sleeve 40 should be made out of materials that allow the user to firmly, securely and comfortably grip the handle 14 of the implement 12. For instance, the grip sleeve 40 can be made out of rubber, plastic, leather and a variety of other materials, including materials which are commonly utilized as prior art gripping surfaces. The grip sleeve 40 has a first or upper end 46 and a second or lower end 48. Typically, but not necessarily always, the upper end 46 of the grip sleeve 40 will be at or near the upper end 42 of the gripping section 32 and the lower end 48 of the grip sleeve 40 will be at or near the lower end 44 of the gripping section 32 such that the grip sleeve 40 covers and encapsulates the entire gripping section 32 of the handle 14, as shown in FIGS. 1, 2 and 12.

Figure 7:
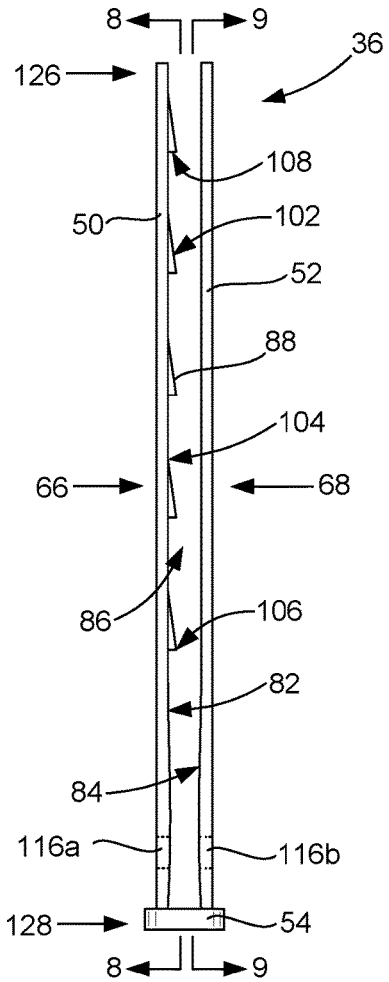
FIG. 7 is a side view of the locking clip utilized to secure the handle grip of FIG. 2 to the gripping section of the handle of an implement.
Figure 8:
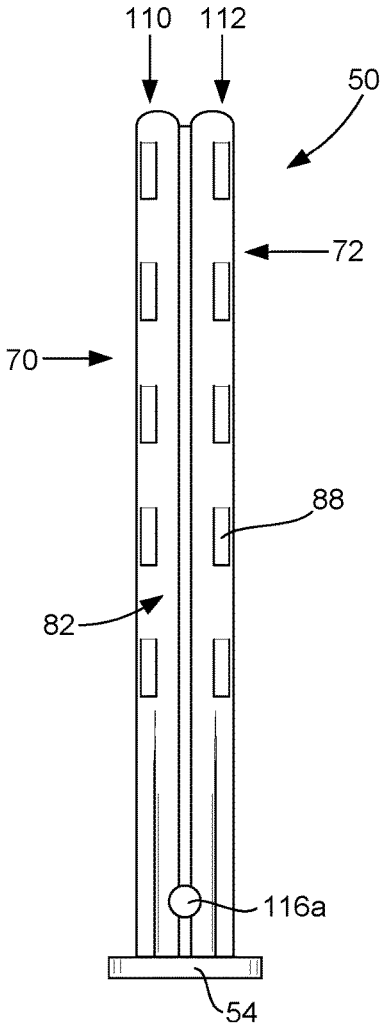
FIG. 8 is a cross-sectional view of the locking clip of FIG. 7 taken through lines 8-8 thereof showing a back view of the left or first locking member of the locking clip.
Figure 9:
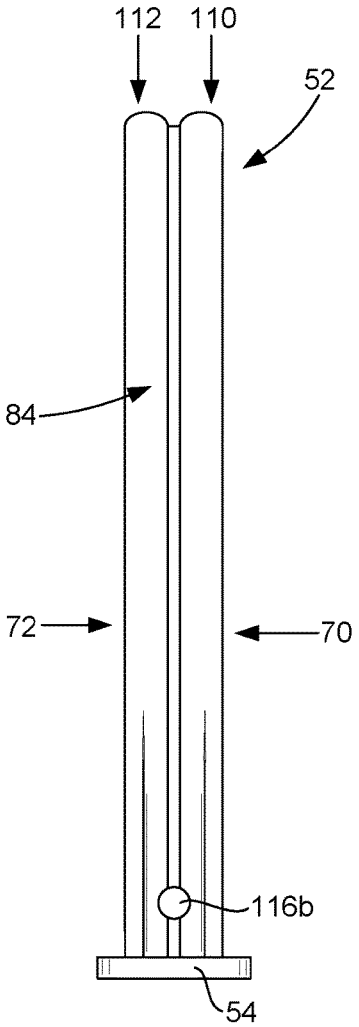
FIG. 9 is a cross-sectional view of the locking clip of FIG. 7 taken through lines 9-9 thereof showing a front view of the right or second locking member of the locking clip.
Figure 10:
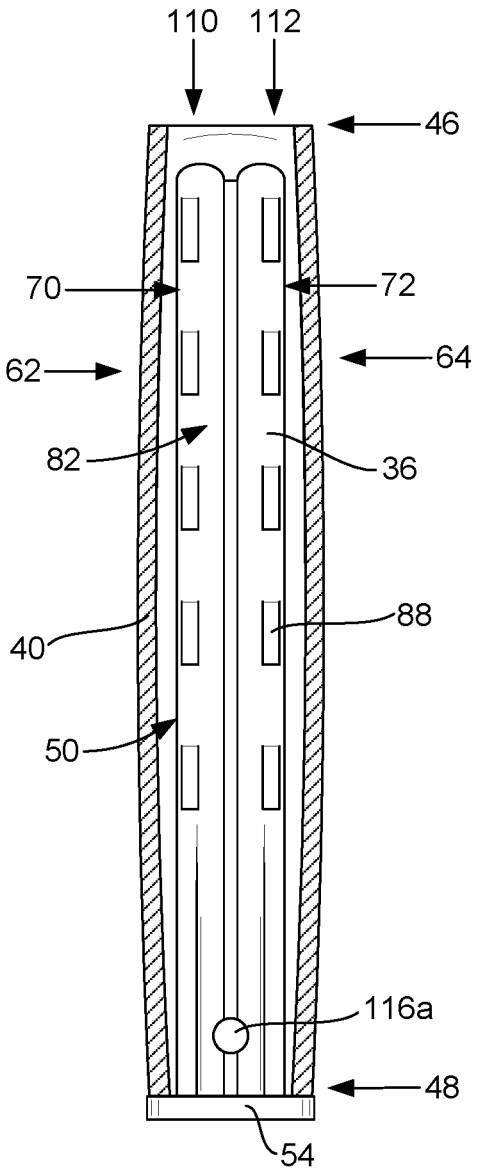
FIG. 10 is a cross-sectional view of the implement handle grip of FIG. 6 taken through lines 10-10 thereof showing a back view of the left or first locking member of the locking clip of FIG. 8 positioned in the grip sleeve of the handle grip.
Figure 11:
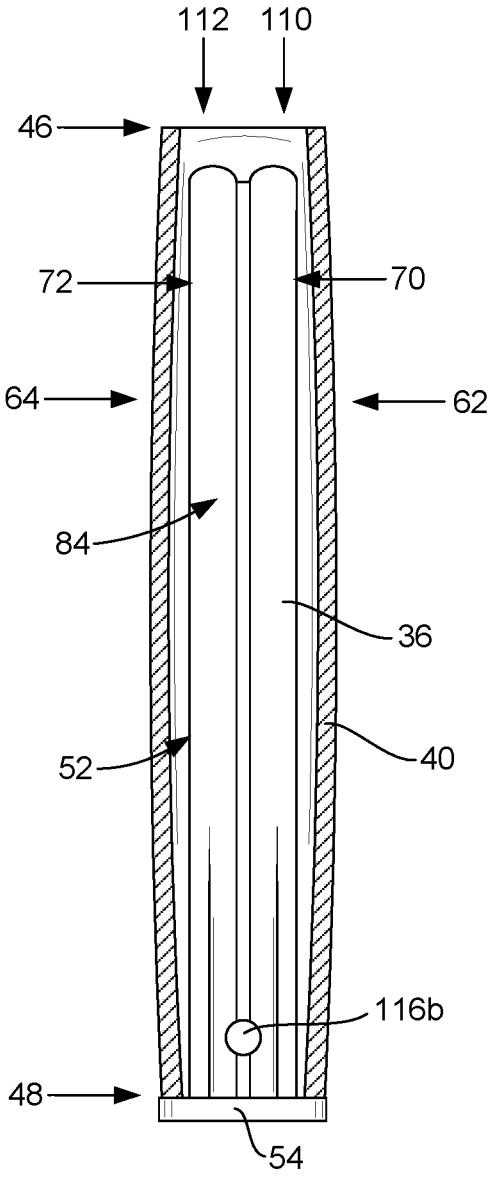
FIG. 11 is a cross-sectional view of the implement handle grip of FIG. 6 taken through lines 11-11 thereof showing a front view of the right or second locking member of the locking clip of FIG. 9 positioned in the grip sleeve of the handle grip.

As set forth above, the grip securing mechanism 34 is utilized to securely and safely attach the grip sleeve 40 to the gripping section 32 of the handle 14. The grip securing mechanism 34 comprises a locking clip 36 that is structured and arranged with some of its components received inside the interior channel 56 of the grip sleeve 40 and configured to engage certain features, as described below, of the handle 14. In a preferred embodiment, the locking clip 36, which is best shown in FIGS. 5-11, comprises one or more elongated locking members, such as the front or first locking member 50 and the back or second locking member 52 (which are best shown in FIGS. 6 and 7), that extend upward to the upper end 126 of the locking clip 36 from a base member 54 at the lower end 128 thereof, as best shown in FIG. 7. As shown in the figures, the base member 54 interconnects the two locking m embers 50/52 at the lower end 128 of the locking clip 36. In the embodiment shown in the figures, the first locking member 50 and the second locking member 52 are each sized and configured to extend substantially to the upper end 46 of the grip sleeve 40 when the locking clip 36 is inserted inside the tubular grip sleeve 40 and the base member 54 is positioned at the lower end 48 of the tubular grip sleeve 40, as shown in FIGS. 1-2, 6 and 10-12. In a preferred embodiment of the new handle grip 10, the grip securing mechanism 34 also comprises a locking pin 38, best shown in FIG. 2, that is received through at least the grip sleeve 40 and the gripping section 32 of the handle 14 so as to more securely join the grip sleeve 40 to the handle 14. In the embodiment shown in the figures, the locking pin 38 is also received through both locking members 50/52 of the locking clip 36, as shown in FIGS. 1 and 12. As will be set forth in more detail below, wherein the configuration and use of the locking clip 36 and locking pin 38 are explained, the locking clip 36 and locking pin 38 are configured to cooperate with grip sleeve 40 and the gripping section 32 of the handle 14 to easily, securely and safely join the new handle grip 10 to the handle 14 of an implement 12 in a manner that allows the user to relatively easily remove a handle grip 10 and replace it with a new handle grip 10.

When the locking clip 36 is inside the grip sleeve 40, the first locking member 50 of the locking clip 36 is positioned along the front side 58 of the grip sleeve 40 and the second locking member 52 of the locking clip 36 is positioned along the back side 60 of the grip sleeve 40, as shown in FIGS. 5 and 6. The grip sleeve 40 also has a first end 62 and a second end 64, as shown in FIGS. 1-2 and 5. The first locking member 50 extends upward along the front side 66 of the locking clip 36 and the second locking member 52 extends upward along the back side 68 of the locking clip 36, as best shown in FIG. 7. In the configuration of the handle grip 10 shown in FIGS. 1-12, both the first end 70 and the second end 72 of the locking clip 36, which are shown in FIG. 5 are open, as best shown in FIGS. 6 and 7. For purposes of describing the present invention, the gripping section 32 of the handle 14 has a front side 74, which is the view shown in FIGS. 2 and 3, an opposite facing back side 76, a first end 78 and a second end 80, as best shown in FIGS. 2-4. When the grip sleeve 40 is on the handle 14, the front side 58 of the grip sleeve 40 will be in corresponding relation with the front side 74 of the gripping section 32 and the back side 60 of the grip sleeve 40 will be in corresponding relation with the back side 76 of the gripping section 32. Likewise, the first end 62 and second end 64 of the grip sleeve 40 will be in corresponding relation, respectively, with the first end 78 and second end 80 of the gripping section 32 of handle 14.

Figure 13:
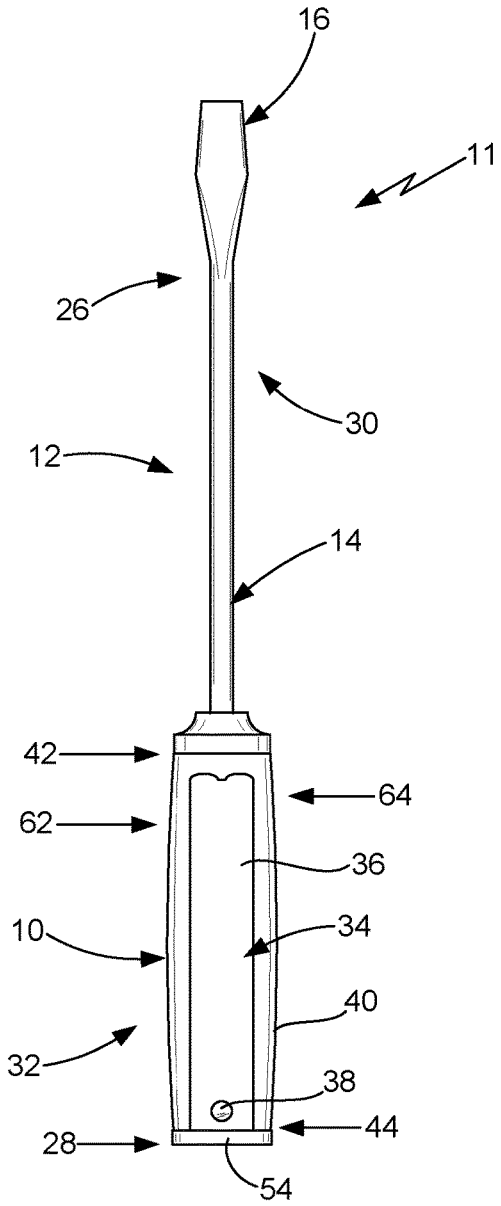
FIG. 13 is a side view of a handle grip that is configured according to a second embodiment of the present invention, with the handle grip shown attached to the handle of an implement that is configured as a screwdriver.

In a preferred embodiment of the handle grip 10 of the present invention, the first locking member 50 and the second locking member 52 of the locking clip 36 are integrally formed with the base member 54 thereof to form a single component. The first locking member 50 and second locking member 52 extend upwardly from the base member 54 in spaced apart relation to each other with the back facing engaging surface 82 of the first locking member 50 spaced apart from the front facing engaging surface 84 of the second locking member 52 so as to define a gap 86 therebetween, as best shown in FIGS. 5-7. The gap 86 between the two locking members 50/52 is sized and configured to receive the gripping section 32 therebetween so the engaging surface 82 of the first locking member 50 will be in contact with the front side 74 of the gripping section 32 of the handle 14 and the engaging surface 84 of the second locking member 52 will be in contact with the back side 76 of the gripping section 32 of the handle 14, as best shown in FIG. 12, to form a substantially unified handle 14 and grip sleeve 40, as shown in FIGS. 1 and 13. In one embodiment, the locking clip 36 can be easily and relatively inexpensively molded out of plastic or the like. As will be readily appreciated by persons skilled in the art, the two locking members 52/54 will have to be sufficiently rigid and strong to accomplish the objective of joining the locking clip 36 to the handle 14.

To further accomplish the objective of joining the grip sleeve 40 to the gripping section 32 of the handle 14, the locking clip 36 has one or more, preferably a plurality, of outwardly extending engaging members 88 on at least the engaging surface 82 of the first locking member 50, as best shown in FIGS. 5-8 and 10. In the preferred embodiment, the engaging members 88 are integrally formed with the subject locking member or members (i.e., first locking member 50). In an alternative embodiment, the engaging members 88 can be attached to the locking members 50/52. The engaging members 88 are sized and configured to extend outward from the engaging surface 82 into the gap 86 between the two locking members 50/52 and engage the gripping section 32 of the handle 14. To facilitate such engagement, the handle body 90 at the gripping section 32 comprises a grip engaging pattern 92 on at least the front engaging surface 94, which corresponds to the front side 74, of the gripping section 32, as shown in FIGS. 2 and 3. In one embodiment, the handle body 90 also has a corresponding grip engaging pattern 92 on the opposite facing back engaging surface 96, which corresponds to the back side 76, of the gripping section 32 of handle 14. Having a corresponding grip engaging pattern 92 on both the engaging surfaces 94/96 of the handle body 90 at gripping section 32 will allow the grip sleeve 40 to go on the gripping section 32 in either direction and/or allow use of engaging members 88 on the front facing engaging surface 84 of the second locking member 52 of the locking clip 36 as well as the engaging surface 82 of the first locking member 50. When the locking clip 36 is inside the grip sleeve 40 and the handle body 90 is in the gap 86, the engaging surface 82 of the first locking member 50 will be generally parallel the first engaging surface 94 of the handle body 90 and the engaging surface 84 of the second locking member 52 will be generally parallel the second engaging surface 96 of the handle body 90, as shown with regard to FIGS. 6, 7, 12 and 14.

As will be readily appreciated by persons who are skilled in the art, a wide variety of cooperatively configured engaging members 88 and grip engaging patterns 92 are likely to be suitable for use with the handle grip 10 of the present invention. The grip engaging patterns 92 for use with the handle grip 10 will have one or more, typically a plurality of, engaging elements. In the embodiments shown in the figures, the engaging elements of the grip engaging pattern 92 on the gripping section 32 of the handle 14 comprises a plurality of ridges 98 and open areas 100 between the ridges 98, as best shown in FIGS. 2 and 3, that are cooperatively configured with the engaging members 88 on the locking clip 36 to securely join the handle grip 10 to the handle 14 of the implement 12. Although the open areas 100 can be cavities in and/or apertures through the handle body 90 that receive and engage the engaging members 88 on the locking clip 36, in a preferred embodiment the open areas 100 do not create holes in the handle body 90 to prevent any potentially undesirable loss of strength for the implement 12 (which may be necessary or important to prevent for some types of implements 12). The ridges 98 and open areas 100 of the grip engaging pattern 92 are sized and configured to engagedly receive the engaging members 88 on the locking clip 36, which will be disposed inside the grip sleeve 40, when the grip sleeve 40 is in position over the gripping section 32 of the handle 14, as shown in FIG. 12. More specifically, the engaging members 88 on the locking clip 36 and the ridges 98 and open areas 100 of the grip engaging pattern 92 are cooperatively configured such that when the gripping section 32 of the handle 14 is in the grip sleeve 40 the outwardly extending engaging members 88 will be received in the open areas 100 and tightly engage the ridges 98 to prevent the handle grip 10 from slipping or becoming disengaged from the handle 14 during use of the implement 12. If desired, the configuration of the engaging members 88 and the engaging elements 98/100 can be reversed such that the engaging surface 94 of the handle body 90 engages the first locking member 50 of the locking clip 36.

In a preferred configuration of the present invention, each of the engaging members 88 of the locking clip 36 are structured and arranged to allow the handle grip 10, with the locking clip 36 inside the grip sleeve 40, to relatively easily move upward along the gripping section 32 when the handle grip 10 is being placed on the handle 14 but prevent any downward movement of handle grip 10 once the handle grip is in place on the gripping section 32 (i.e., fully between the upper end 42 and lower end 44 of the gripping section 32). In the embodiment shown in the figures, the engaging members 88 have a generally downwardly directed outward sloping surface 102 that slopes outward (i.e., away from the engaging surface 82) from the upper end 104 of each engaging member 88 to the lower end 106 thereof, which forms an outwardly extending, downwardly disposed engaging edge 108, as best shown in FIG. 7, that will engage the ridges 98 of the grip engaging pattern 92 when the handle grip 10 is in place over the gripping section 32 of the handle 14. As will be readily appreciated by persons skilled in the relevant art, the downwardly directed outward sloping surface 102, with the upper end 104 being substantially even with (or not much outward from) the back facing engaging surface 82 of the first locking member 50, of the engaging members 88 will allow the locking clip 36 (which is inside the grip sleeve 40 of the handle grip 10) to slide upward along the grip engaging pattern 92 of the gripping section 32 of the handle 14 when placing the handle grip 10 on the handle 14, but prevent any downward movement of the handle grip 10 once the engaging edge 108 of the engaging member 88 is engaged against a ridge 98 of the grip engaging pattern 92 on the gripping section 32 of handle 14. Properly sized and arranged, the cooperatively configured engaging members 88 and grip engaging pattern 92 will securely join the handle grip 10 to the handle 14 to prevent slippage or disengagement of the handle grip 10 when the implement 12 is in use. As such, care will have to be taken in the design and manufacture of the handle grip 10 and the handle 14 with which the handle grip 10 will be utilized to ensure that the grip engaging pattern 92 is configured such that when the handle grip 10 is at its desired location (i.e., the upper end 46 of the grip sleeve 40 at the upper end 42 of the gripping section 32), the engaging edge 108 of the engaging member 88 will be tightly against one of the ridges 98 of the grip engaging pattern 92 on the handle body 90 of the gripping section 32.

A wide variety of different configurations are likely possible for the locking clip 36, including the engaging members 88, of the new handle grip 10 and the grip engaging pattern 92 of the gripping section 32 of the handle 14. In the embodiment shown in the figures, the locking clip 36 is comprised of a pair of locking rails, shown as first locking rail 110 and second locking rail 112, as best shown in FIGS. 8-11 on which engaging members 88 are located (i.e., integrally formed). The locking rails 110/112 and the engaging members 88 are structured and arranged to position the engaging members 88 in the open areas 100 of the grip engaging pattern 92 with the engaging edge 108 thereof against a ridge 98 of the grip engaging pattern 92 when the handle grip 10 is on the gripping section 32 of the handle 14. In the figures, the ridges 98 and open spaces 100 of the grip engaging pattern 92 form a plurality of generally diamond and partially diamond shapes that engage the engaging members 88 of the locking clip 36. As set forth above, a variety of other configurations can be utilized for the locking clip 36, engaging members 88 and grip engaging pattern 92.

Although it is anticipated that the locking clip 36 having the engaging members 88 and the gripping section 32 having the grip engaging pattern 92 will be sufficient to securely join the handle grip 10 to the handle 14 of an implement 12, the preferred configuration of the handle grip 10 also utilizes the locking pin 38 to even more securely join the handle grip 10 to the handle 14. As shown in FIGS. 1 and 13, the locking pin 38 is received through both the handle grip 10 and the handle 14 to which the handle grip 10 is joined (as described above) to further reduce the likelihood that the handle grip 10 will slip relative to the handle 14 and/or become disengaged from the handle 14 during use of the implement 12. To utilize the locking pin 38, each of the handle grip 10 and handle 14 have corresponding apertures that are aligned and sized and configured to tightly receive and engage the locking pin 38. More specifically, the grip sleeve 40 has a pin aperture 114 on each side 58/60 that is sized and configured to receive and engage the locking pin 38, the locking clip 36 has a pin apertures 116 on each locking member 50/52 that is sized and configured to receive and engage the locking pin 38 and the gripping section 32 of the handle 14 has a pin aperture 118 that is sized and configured to receive and engage the locking pin 38, as shown in FIGS. 2-4 and 6-11. More specifically, the grip sleeve 40 has a pin aperture 114*a* and pin aperture 114*b* (as shown in FIGS. 2, 6 and 12), the locking clip 36 has a pin aperture 116*a* on the first locking member 50 and a pin aperture 116*b* on the second locking member 52 (as shown in FIGS. 7-11) and the handle 14 has a pin aperture 118 in the gripping section 32 (as shown in FIGS. 2-4). The pin apertures 114/116/118 are positioned on, respectively, the handle grip 10, locking clip 36 and handle 14 so as to be aligned when the handle grip 10 is positioned on the gripping section 32 of the handle 14 so the locking pin 38 will go through the handle grip 10, the locking clip 36 and the handle body 90 of the gripping section 32. In one embodiment, the locking pin 38 tightly engages each of the grip sleeve 40, locking clip 36 and handle 14. In another embodiment, the locking pin 38 tightly engages only one or more of these components. Although the locking pin 38 can be made out of a wide variety of different materials that will provide a sufficiently rigid and strong barrier to the handle grip 10 sliding off of the handle 14 (in addition to the locking clip 36, as described above), it is preferred that the locking pin 38 be made out of a plastic, such as nylon or the like, so it can be drilled out by the user when he or she desires or needs to replace an existing handle grip 10 with a new handle grip 10, as set forth in more detail below. In one embodiment, the locking pin 38 extends completely through the handle grip 10. For the comfort of the user and for aesthetic purposes, however, the locking pin 38 should not extend beyond, or much beyond, the outer surfaces of the grip sleeve 40. In another embodiment, the locking pin 38 enters from one side 58/60 of the grip sleeve 40, but does not extend all the way through to the opposite side 58/60 of the grip sleeve 40.

In the embodiment of FIG. 13, which shows use of the new handle grip 10 with a screwdriver as the implement 12, the grip sleeve 40 is made out a transparent material that will allow the locking clip 36 to be seen from outside the handle grip 10. With the grip sleeve 40 being transparent, the manufacturer of the new handle grip 10 or an implement 12 having the new handle grip 10 thereon can utilize different colors and/or configurations as a way of providing different aesthetics for different handle grips 10 and/or implements 12. Whether the grip sleeve 40 is transparent or not, the grip sleeve 40 can be made in a wide variety of different configurations, as are prior art handle grips.

The present disclosure also describes a handle system 11 for an implement that comprises the new handle grip 10 and handle 14 with a gripping section 32 on which the handle grip 10 is joined, as shown in FIGS. 1, 2 and 13. The features of the system 11 include the various features of the handle grip 10 and handle 14 described above, including the use of the locking clip 36 having the engaging members 88 and the lip engaging pattern 92 on the gripping section 32 of the handle 14. The handle system 11 will be able to be utilized with a wide variety of different types of implements 12 have a working portion 16 that is structured and arranged to accomplish one or more desired tasks. In one embodiment of the system 11, the handle grip 10 and handle 14 are configured as described above with a grip sleeve 40 that has the locking clip 36 with locking members 50/52 having engaging members 88 on at least one side 66/68 of the locking clip 36 and the gripping surface 32 having the grip engaging pattern 92 with a plurality of ridges 98 and open areas 100 that are cooperatively configured with the locking clip 36 to effectively and securely join the handle grip 10 to the handle 14.

In one embodiment of manufacturing the handle grip 10 of the present invention, the locking clip 36 is molded out of plastic or like material and the locking pin 38 is made out of nylon or the like. Once the locking clip 36 is formed (as a separate component), the locking clip 36 is placed around a blank gripping portion 32 of a "handle" or handle-like form that is sized and configured the same as the handle 14 on which the handle grip 10 will be utilized, except the blank griping portion 32 will not have a grip engaging pattern 92 (basically it is only serving as a place holder). With the locking clip 36 in place around the blank gripping portion 32, a grip sleeve mold is placed around the form and the material for the grip sleeve 40 is injected, poured or otherwise put into the mold. Once the grip sleeve 40 sufficiently cools, the handle grip 10 is pulled off of the blank form to provide a handle grip 10 comprised of the locking clip 36 being embedded in the grip sleeve 40. The handle grip 10 can then be attached to a handle 14 having an appropriately sized and configured gripping section 32, namely having a grip engaging pattern 94 that is cooperatively configured with the engaging members 88 on the locking clip 36 that is in the grip sleeve 40. The handle grip 10 is then pushed onto the handle 14 from the lower end 28 thereof until the base member 54 is adjacent to the lower end 28 with the locking clip 36 around the gripping section 32 of the handle 14 and the locking pin 38 is pushed into and through the pin apertures 114/116/118 to extend through the grip sleeve 40, locking clip 36 and handle 14.

Typically, the user will initially receive an implement 12 having the new handle grip 10 of the present invention attached thereto. He or she will then use the implement 12 in the manner in which it was intended. Over time, the handle grip 10 may become worn or damaged such that the user will need or desire to replace the handle grip 10. To remove the handle grip 10 of the present invention, the user merely has to drill out the locking pin 38 (made out of nylon or like material), cut along one or both ends 62/64 of the grip sleeve 40 (typically using a knife, box cutter or the like), peel away one or more sides 58/60 of the grip sleeve 40 away from the grip engaging pattern 94 of the gripping section 32 and then slide the cut handle grip 10 off of the handle 14. Once the handle grip 10 is removed, the user will clean off any, if necessary, leftover material from the grip sleeve 40 that is on the gripping portion 32 to prepare the handle 14 for installation of a new handle grip 10. The user can easily install a new handle grip 10, whether of the same or a different exterior configuration, on the existing handle 14 by pushing the handle grip 10 onto the handle 14 from the lower end 28 thereof until the base member 54 is adjacent the lower end 28 with the locking clip 36 around the gripping section 32 of the handle 14. He or she will the insert the locking pin 38 into and through the pin apertures 114/116/118 of the new handle grip 10 so as to extend the locking pin 38 through the grip sleeve 40, locking clip 36 and handle 14. Once the locking pin 38 is in place, the implement 12 will have the new handle grip 10 securely and safely positioned thereon.

Figure 14:
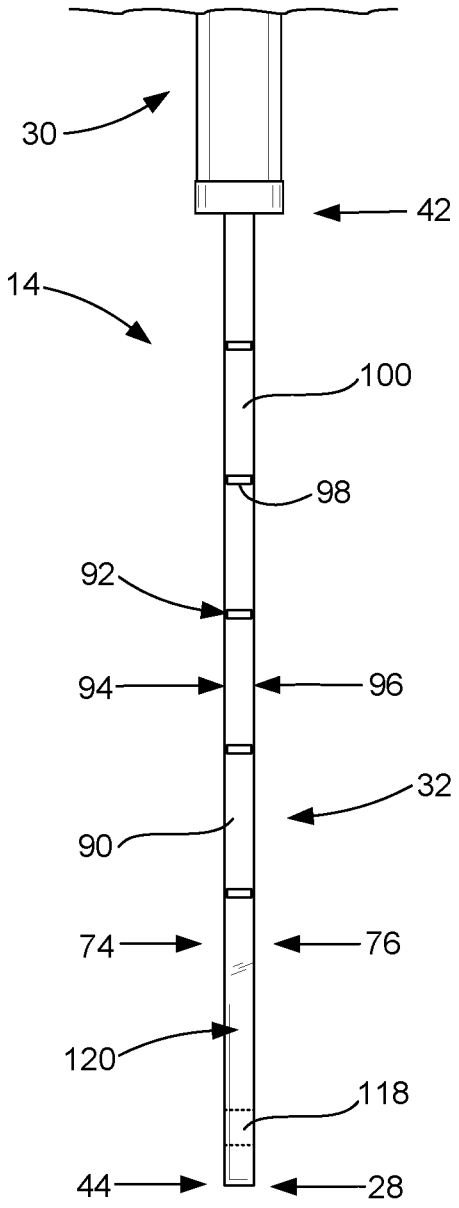
FIG. 14 is an end view of the gripping section of a handle that is configured according to a third embodiment of the present invention with a grip engaging pattern on the first end thereof.
Figure 15:
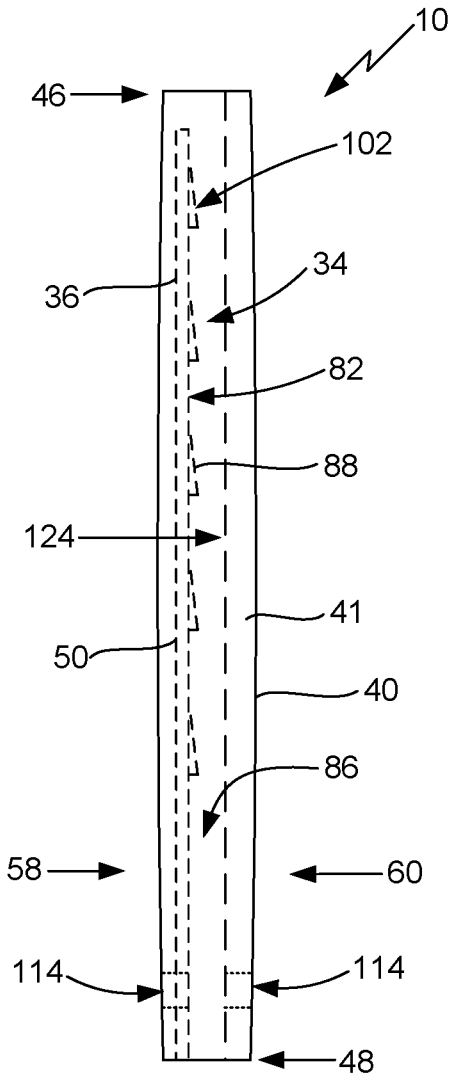
FIG. 15 is an end view of a handle grip that is configured according to a fourth embodiment of the present invention, showing use of a locking grip with only a first locking member.
Figure 16:
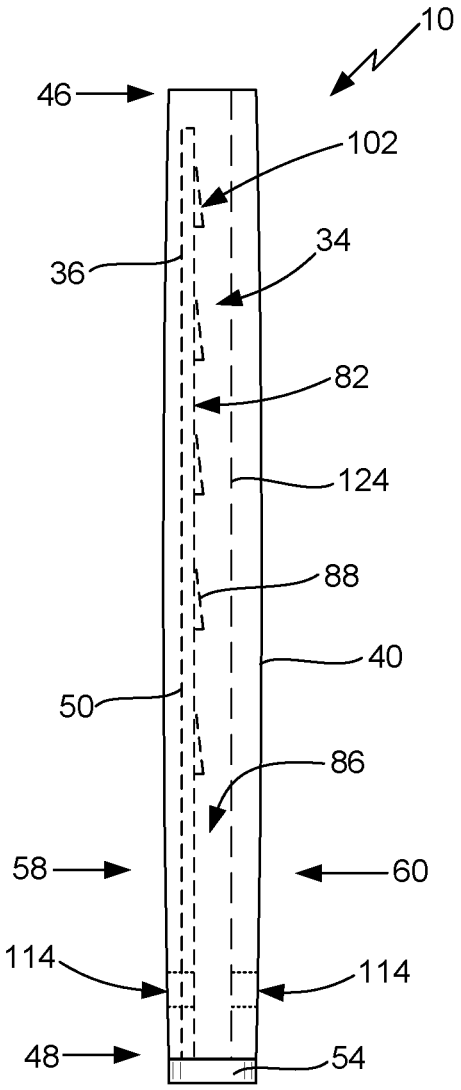
FIG. 16 is an end view of a handle grip that is configured according to a fifth embodiment of the present invention, showing use of a locking grip with only a first locking member and base member.

As will be readily appreciated by persons who are skilled in the relevant art, there are a number of variations that can be made to the handle grip 10 described above that still fall within the scope of the present invention. For instance, as set forth above, the locking clip 36 and the gripping section 32 of the handle 14 with which the handle grip 10 will be utilized can be configured with the locking clip 36 having engaging members 88 on both locking members 50/52 and the gripping section 32 having the cooperatively configured grip engaging pattern 92 on both the front 94 and the back 96 surfaces of the handle body 90 so the locking clip 36 will engage both sides 74/76 of the gripping section 32 of the handle 14 on which the handle grip 10 is utilized. In another embodiment, the locking clip 36 could be sized and configured to engage a grip engaging pattern 92 that is placed on the first 78 and second 80 ends of the gripping section 32. More specifically, the locking clip 36 could have engaging members 88 that are cooperatively configured with a grip engaging pattern 92 on the first end engaging surface 120 and/or the second end engaging surface 122 of the handle body 90 at the gripping section 32 of the handle 14, as shown in FIG. 14, instead of along the front engaging surface 94 and/or the back engaging surface 96 of the handle body 90 as described above. The grip engaging pattern 92 utilized on the first end surface 120 and/or second end surface 122 can comprise, if desired, the ridges 98 and open spaces 100 described above and shown in FIG. 14, that are sized and configured to engage the cooperatively configured engaging members 88 of the locking clip 36. In yet another alternative embodiment, the locking clip 36 can comprise just a single locking member, such as just the first locking member 50, as shown in FIG. 15, instead of having two locking members 50/52 inside the grip sleeve 40, and not utilize the base 14. If desired, a single locking member 50 can be attached to the base 14, as shown in FIG. 16. In either of the embodiments of FIGS. 15 and 16, the opposite facing surface on the opposite side of the handle body 90 (i.e., the back surface 96) will be pressed against the inner wall 124 of the grip sleeve 40, shown in FIGS. 15 and 16, when the handle grip 10 is pressed onto the gripping section 32 of the handle 14, as described above, instead of having the second locking member 52 against the opposite facing surface of the handle body 90.

While there are shown and described herein specific forms of the invention, it will be readily apparent to those of ordinary skill in the art that the invention is not so limited, but instead is susceptible to various modifications and rearrangements in design and materials without departing from the spirit and scope of the invention. The embodiments described herein and shown in the figures were chosen in order to best explain the principles of the present invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A handle grip for placement on a handle body of a gripping section of a handle, the handle body of the gripping section of the handle having at least a first engaging surface and a second engaging surface, said handle grip comprising:

a tubular grip sleeve having one or more walls defining an interior channel through said grip sleeve between an upper end and a lower end thereof, said tubular grip sleeve sized and configured to substantially surround the handle body of the gripping section of the handle when the gripping section of the handle is positioned in said interior channel of said grip sleeve;

grip securing means for securing said grip sleeve to the handle body of the gripping section of the handle, said grip securing means comprising a first locking member having an engaging surface, said first locking member positioned in said interior channel of said grip sleeve so as to dispose said engaging surface of said first locking member substantially adjacent the first engaging surface of the handle body of the handle when the gripping section thereof is positioned in said interior channel of said grip sleeve, the first engaging surface of the handle body having a grip engaging pattern with one or more engaging elements; and one or more engaging members on said engaging surface of said first locking member, each of said engaging members sized and configured to engage at least one of said engaging elements of said grip engaging pattern so as to securely attach said grip sleeve to the handle when said grip sleeve is positioned on the gripping section of the handle.

2. The handle grip of claim 1, wherein said first locking member extends substantially between the lower end of the gripping section and the upper end of the gripping section.

3. The handle grip of claim 1, wherein said engaging surface of said first locking member is substantially parallel to the first engaging surface of the handle body of the gripping section of the handle.

4. The handle grip of claim 1, wherein said grip securing means further comprises a second locking member having an engaging surface, said second locking member positioned in said interior channel of said grip sleeve so as to dispose said engaging surface of said second locking member in spaced apart relation to said engaging surface of said first locking member to define a gap therebetween, said engaging surface of said second locking member positioned substantially adjacent the second engaging surface of the handle body when the gripping section of the handle is positioned in said gap between said first locking member and said second locking member.

5. The handle grip of claim 4, wherein said engaging surface of said second locking member also comprises said engaging members and the second engaging surface of the handle body also comprises said grip engaging pattern with said engaging elements, said engaging members on said engaging surface of said second locking member engaging said engaging elements of said grip pattern on said second engaging surface when said grip sleeve is positioned on the gripping section of the handle.

6. The handle grip of claim 1, wherein said grip securing means further comprises a locking pin that is received through a pin aperture on said grip sleeve and a pin aperture through the handle body so as to interconnect said handle grip and the handle, said locking pin sized and configured to engage at least one of said grip sleeve and the handle body so as to securely join said grip sleeve to the gripping section of the handle.

7. The handle grip of claim 6, wherein said grip securing means further comprises a pin aperture on said first locking member, said locking pin sized and configured to be received through said pin aperture on said first locking member.

8. The handle grip of claim 1, wherein said grip securing means further comprises a locking clip having said first locking member, a second locking member in spaced apart relation to said first locking member and a base member interconnecting said first locking member and said second locking member at a lower end of said locking clip, said second locking member having an engaging surface, said engaging surface of said first locking member and said engaging surface of said second locking member defining a gap therebetween, said locking clip sized and configured so as to position said base member at said lower end of said grip sleeve when each of said first locking member and said second locking member are in said interior channel of said grip sleeve and to dispose said base member at a lower end of the gripping section when said handle grip is positioned on the gripping section of the handle with the gripping section thereof disposed in said gap.

9. The handle grip of claim 8, wherein said base member is sized and configured to at least substantially cover said interior channel at said lower end of said grip sleeve.

10. The handle grip of claim 8, wherein said grip securing means further comprises a locking pin that is received through a pin aperture on said grip sleeve, at least one of a pin aperture on said first locking member and a pin aperture on said second locking member, and a pin aperture on the handle body so as to interconnect said grip sleeve, said locking clip and the handle, said locking pin sized and configured to engage at least one of said pin aperture on said grip sleeve, said pin aperture on said first locking member or said pin aperture on said second locking member, and said pin aperture on the handle body so as to securely join said handle grip to the gripping section of the handle.

11. The handle grip of claim 8, wherein said engaging surface of said second locking member also comprises said engaging members and the second engaging surface of the handle body also comprises said grip engaging pattern with said engaging elements, said engaging members on said engaging surface of said second locking member engaging said engaging elements of said grip pattern when said grip sleeve is positioned on the gripping section of the handle.

12. The handle grip of claim 1, wherein said engaging elements of said grip engaging pattern comprises a plurality of ridges and open spaces between said ridges, each of said engaging members having an engaging edge that is sized and configured to engage one of said ridges.

13. The handle grip of claim 1, wherein each of said engaging members have a downwardly directed outward sloping surface that defines a downwardly disposed engaging edge that is sized and configured to engage one of said engaging elements of said grip engaging pattern.

14. A handle grip for placement on a handle body of a gripping section of a handle, the handle body of the gripping section of the handle having at least a first engaging surface and a second engaging surface, said handle grip comprising:

a tubular grip sleeve having one or more walls defining an interior channel through said grip sleeve between an upper end and a lower end thereof, said tubular grip sleeve sized and configured to substantially surround the handle body of the gripping section of the handle when the gripping section of the handle is positioned in said interior channel of said grip sleeve;

grip securing means for securing said grip sleeve to the handle body of the gripping section of the handle, said grip securing means comprising a locking clip having a first locking member, a second locking member in spaced apart relation to said first locking member and a base member interconnecting said first locking member and said second locking member, said first locking member having an engaging surface, said second locking member having an engaging surface, said engaging surface of said first locking member and said engaging surface of said second locking member defining a gap therebetween, each of said first locking member and said second locking member positioned in said interior channel of said grip sleeve so as to dispose said engaging surface of said first locking member substantially adjacent the first engaging surface of the handle body of the handle and said engaging surface of said second locking member substantially adjacent the second engaging surface of the handle body when the gripping section of the handle body is positioned in said interior channel of said grip sleeve, the first engaging surface of the handle body having a grip engaging pattern with one or more engaging elements; and one or more engaging members on said engaging surface of said first locking member, each of said engaging members sized and configured to engage at least one of said engaging elements of said grip engaging pattern so as to securely attach said grip sleeve to the handle when said grip sleeve is positioned on the gripping section of the handle.

15. The handle grip of claim 1, wherein said locking clip is sized and configured so as to position said base member at said lower end of said grip sleeve when each of said first locking member and said second locking member are fully disposed in said interior channel of said grip sleeve and to dispose said base member at a lower end of the gripping section when said handle grip is positioned on the gripping section of the handle with the gripping section thereof disposed in said gap.

16. The handle grip of claim 14, wherein said engaging surface of said second locking member also comprises said engaging members and the second engaging surface of the handle body also comprises said grip engaging pattern with said engaging elements, said engaging members on said engaging surface of said second locking member engaging said engaging elements of said grip pattern on said second engaging surface when said grip sleeve is positioned on the gripping section of the handle.

17. The handle grip of claim 14, wherein said grip securing means further comprises a locking pin that is received through a pin aperture on said grip sleeve, at least one of a pin aperture on said first locking member and a pin aperture on said second locking member, and a pin aperture on the handle body so as to interconnect said grip sleeve, said locking clip and the handle, said locking pin sized and configured to engage at least one of said grip sleeve, said first locking member or said second locking member, and the handle body so as to securely join said handle grip to the gripping section of the handle.

18. The handle grip of claim 14, wherein each of said engaging members have a downwardly directed outward sloping surface that defines a downwardly disposed engaging edge that is sized and configured to engage one of said engaging elements of said grip engaging pattern.

19. A handle system, comprising:

a handle having a gripping section;

a handle body of said gripping section, said handle body having at least a first engaging surface and an opposite facing second engaging surface, at least said first engaging surface of said handle body having a grip engaging pattern with one or more engaging elements;

a handle grip having a tubular sleeve and a grip securing means for securing said grip sleeve to said handle body, said tubular grip sleeve having one or more walls defining an interior channel through said grip sleeve between an upper end and a lower end thereof, said tubular grip sleeve sized and configured to substantially surround said handle body when said gripping section of said handle is positioned in said interior channel of said grip sleeve, said grip securing means having a locking clip with a first locking member, a second locking member in spaced apart relation to said first locking member and a base member interconnecting said first locking member and said second locking member, each of said first locking member and said second locking member positioned in said interior channel of said grip sleeve, said first locking member having an engaging surface, said second locking member having an engaging surface, said engaging surface of said first locking member and said engaging surface of said second locking member in opposing relation so as to define a gap therebetween; and one or more engaging members on said engaging surface of said first locking member, each of said engaging members sized and configured to engage at least one of said engaging elements of said grip engaging pattern so as to securely attach said grip sleeve to said handle when said grip sleeve is positioned on said gripping section of said handle with said engaging surface of said first locking member at least substantially adjacent said first engaging surface of said handle body and said engaging surface of said second locking member at least substantially adjacent said second engaging surface of said handle body when said gripping section of said handle is positioned in said interior channel of said grip sleeve with said gripping section disposed in said gap.

20. The handle system of claim 19, wherein said grip securing means further comprises a locking pin that is received through a pin aperture on said grip sleeve, at least one of a pin aperture on said first locking member and a pin aperture on said second locking member, and a pin aperture on said handle body so as to interconnect said grip sleeve, said locking clip and said handle, said locking pin sized and configured to engage at least one of said grip sleeve, said first locking member or said second locking member, and said handle body so as to securely join said handle grip to said gripping section of said handle.

21. The handle system of claim 19, wherein each of said engaging members have a downwardly directed outward sloping surface that defines a downwardly disposed engaging edge that is sized and configured to engage one of said engaging elements of said grip engaging pattern.

* * * * *